United States Patent [19]

Vogel et al.

[11] Patent Number: 5,004,478

[45] Date of Patent: Apr. 2, 1991

[54] MOTOR FUEL FOR INTERNAL COMBUSTION ENGINES

[75] Inventors: Hans-Henning Vogel, Frankenthal; Hans P. Rath, Gruenstadt; Claus P. Jakob, Viernheim; Knut Oppenlaender, Ludwigshafen, all of Fed. Rep. of Germany

[73] Assignee: BASF Aktiengesellschaft, Ludwigshafen, Fed. Rep. of Germany

[21] Appl. No.: 429,814

[22] Filed: Oct. 31, 1989

[30] Foreign Application Priority Data

Nov. 17, 1988 [DE] Fed. Rep. of Germany ..... 3838918

[51] Int. Cl.[5] ..... C10L 1/18

[52] U.S. Cl. ..... 44/398; 44/418; 44/443

[58] Field of Search ..... 44/77, 62, 66, 71, 72, 44/70, 73

[56] References Cited

U.S. PATENT DOCUMENTS

| | | | |
|---|---|---|---|
| 2,568,876 | 9/1951 | White et al. | 44/63 |
| 3,294,500 | 12/1966 | Zimmermann et al. | 44/70 |
| 3,449,250 | 6/1969 | Fields et al. | 44/63 |
| 3,658,494 | 4/1972 | Dorer | 44/63 |
| 3,658,495 | 4/1972 | Dorer, Jr. | 44/63 |
| 3,756,793 | 9/1973 | Robinson | 44/62 |
| 3,951,614 | 4/1976 | Honnen et al. | 44/71 |
| 4,200,518 | 4/1980 | Mulvany | 208/48 |
| 4,844,714 | 7/1989 | Vogel et al. | 44/63 |

FOREIGN PATENT DOCUMENTS

| | | |
|---|---|---|
| 0061895 | 10/1982 | European Pat. Off. . |
| 0235868 | 9/1987 | European Pat. Off. . |
| 793460 | of 1958 | United Kingdom . |
| 1217468 | 3/1970 | United Kingdom . |
| 2081229 | 1/1982 | United Kingdom . |

*Primary Examiner*—Margaret B. Medley
*Attorney, Agent, or Firm*—Keil & Weinkauf

[57] ABSTRACT

A motor fuel for internal combustion engines contains a small amount of an additive comprising (a) a conventional amino- or amido-containing detergent for cleaning, or keeping clean, the intake system and (b) as base oil a mixture of (ba) a polyether based on propylene oxide or butylene oxide and having a molecular weight of not less than 500 and (bb) an ester of a monocarboxylic or polycarboxylic acid and an alkanol or polyol, this ester having a minimum viscosity of 2 $mm^2/s$ at 100° C.

3 Claims, No Drawings

MOTOR FUEL FOR INTERNAL COMBUSTION ENGINES

The present invention relates to a motor fuel for internal combustion engines which contains a small amount of an additive comprising a conventional amino-or amido-containing detergent for cleaning, or keeping clean, the fuel intake system and, as the base oil, a mixture of a polyether and an alkanol or polyol ester.

The use of a detergent as a motor fuel additive for cleaning, and keeping clean, the mixture formation and intake system of gasoline engines (carburetor, injection nozzles, intake valves, mixture distributor) is known.

In practical use, the detergent, which has a wide variety of chemical compositions, is in general combined with a base oil. The base oil forms a solvent or washing function in combination with the detergent. The base oil is in general a high-boiling, viscous, thermostable liquid. It covers the hot metal surface (for example the intake valves) with a thin film of liquid, and thereby prevents or delays the formation or deposition of decomposition products on the metal surface. In practice, the base oil is frequently a high-boiling, refined mineral oil fraction (usually a vacuum distillate). A particularly suitable base oil is brightstock combined with a low-boiling, highly refined lubricating oil fraction. The base oil may also be a synthesis component. Esters in particular have been described as suitable base oils (e.g. DE 1,062,484, DE 2,129,461 and DE 2,304,086).

Similarly, polyethers have previously been used as motor fuel additives or as constituents of motor fuel additive mixtures.

The effectiveness of known detergents in cleaning, or keeping clean, the intake system is very strongly dosage-dependent. Other factors are engine design, driving conditions, and in particular the composition of the motor fuel. Motor fuels which contain a high proportion of olefin-rich fractions (diolefins of the lower boiling range, cracking components from thermal and catalytic crackers, visbreaker gasoline, coker gasoline and in particular high-boiling pyrolysis gasoline fractions) are particularly prone to form deposits in the intake system of gasoline engines. To keep the carburetors of such engines clean, it is sufficient to add the known detergents in amounts of 100–200 ppm. In the case of modern high performance engines, however, the entire intake system, in particular the intake valves, must be kept clean for trouble-free operation. To meet this absolute requirement, the known detergents must be used in amounts of above 200 ppm, in some instances up to 1000 ppm. However, such high detergent concentrations lead to undesirable side reactions.

For instance, detergents based on polyisobutene having a molecular weight $\overline{M}_n$ of 950 or higher tend to form sticky residues on the valve stems. In the extreme case this leads to valve stick. Since under these conditions the valves no longer close in the extreme case, such an engine can no longer be started.

All the known detergents are high-boiling and sparingly volatile substances. As a result of the inevitable dilution of the engine oil by gasoline in the course of daily operation, there is a noticeable detergent buildup in the engine oil in the interval between oil changes. Whereas the gasoline components gradually evaporate out of the oil, in particular once the engine is hot, the detergents remain in the oil sump. As a consequence, the oil thickens in the interval between oil changes, its viscosity increases, it is increasingly contaminated with foreign substances, and its dispersing effect is no longer sufficient to disperse solids. Precipitates form and the oil becomes sludgy long before the next scheduled oil change.

Since the detergent buildup in the engine oil is proportional to the level of motor fuel additives and because of the increasingly longer periods between oil changes, it is an object of the present invention to develop such additive packets where the basic level of detergent is relatively low.

We have found, surprisingly, that this object is achieved by using a certain base oil mixture comprising a polyether and a high-boiling or sparingly volatile aliphatic or aromatic carboxylic ester insofar as this mixture gives an unexpected synergistic effect and requires only a relatively small amount of detergent.

The present invention accordingly provides a motor fuel for internal combustion engines, containing a small amount of additive comprising (a) a conventional amino- or amido-containing detergent for cleaning, or keeping clean, the intake system and (b) as base oil a mixture of (ba) a polyether based on propylene oxide or butylene oxide and having a molecular weight of not less than 500 and (bb) an ester of a monocarboxylic or polycarboxylic acid and an alkanol or polyol, this ester having a minimum viscosity of 2 $mm^2/s$ at 100° C. and the weight ratio of the polyether to the ester being from 20:80 to 80:20.

The amount of mixture (b) present in the motor fuel is in general from 50 to 5000 ppm, preferably from 100 to 2000 ppm, that of (a) in general from 50 to 1000 ppm, preferably from 50 to 400 ppm.

A motor fuel for an internal combustion engine is an organic, usually predominantly hydrocarbon-containing liquid which is suitable for operating Otto, Wankel and Diesel engines. Besides petroleum fractions it also contains coal hydrogenation hydrocarbons, alcohols of varying origins and compositions and also ethers, e.g. methyl tert-butyl ether. The permissible mixtures are usually laid down by national legislation.

Suitable amino- or amido-containing detergents (a) are for example:

A: polyisobutylamine obtained by hydroformylation of reactive polyisobutylene, average molecular weight 1000, to give polyisobutyl alcohol and subsequent reductive amination with ammonia to polyisobutylamine, B: reaction product of ethylenediaminetetraacetic acid (EDTA) and monoisotridecylamine in a molar ratio of 1:3, as described in DE-A-2,624,630, C: reaction product of EDTA with a mixture of monoisotridecylamine and diisotridecylamine (1:1 parts by weight) in a molar ratio of 1:3.5, as described in DE-A-2,624,630, and D: butoxylate obtained by reaction of isononanoic acid with diethylenetriamine in a molar ratio of 2:1 and subsequent reaction of the resulting diamide with 30 moles of 1-butene oxide, as described in EP-A-81,744.

It is similarly possible to use polybuteneamines prepared by other methods (for example by chlorination of polyisobutylene of molecular weight 1000 and subsequent reaction with mono- or diamines or oligoamines such as diethylenetriamine or triethylenetetramine and also alkanolamines, such as aminoethylethanolamine).

It is also possible to use polycarboxamides (for example phthalamides or phthalimides), amides and/or imides of nitrilotriacetic acid, obtained by reacting the acids or anhydrides with long-chain mono- or polyamines ($C_8$ to $C_{18}$) or fatty amines, for example cocoamine or dicocoamine or else for example diethylenetriamine dioleamide.

Suitable polyethers (ba) are in general polyalkylene oxides. To be effective as a base oil, a polyether must have a minimum molecular weight of above 500. The viscosity of these polyethers is usually distinctly higher than that of the esters described hereinafter. Polyalkylene oxides have in most cases high viscosity indices. This makes them suitable base oils, in particular in combination with esters according to the present invention, for the formulation of additive packets which are not prone to valve stick. Suitable starter molecules for the polyalkylene oxides are aliphatic and aromatic mono-, di- or polyalcohols or even amines or amides and alkylphenols.

Preferred olefin oxides for suitable polyethers are propylene oxide and butene oxides and mixtures thereof. But it is also possible to use pentene oxide and higher oxides for preparing polyethers for inclusion in the combination according to the present invention.

Specific examples of suitable polyethers are the following:

| | Starter molecule | Butene oxide [mole] | Propene oxide [mole] |
|---|---|---|---|
| 1 | hexanediol | 0 | 30 |
| 2 | isotridecanol | 15 | 22 |
| 3 | isotridecanol | 8 | 0 |
| 4 | isononylphenol | 8 | 0 |
| 5 | isododecylphenol | 0 | 12 |
| 6 | isotridecylamine | 24 | 0 |
| 7 | bisphenol A | 24 | 0 |

Esters as per (bb) are for example esters of aliphatic or aromatic mono- or polycarboxylic acids with long-chain alcohols; they are liquids of a certain viscosity. However, for use as base oils for motor fuel additives such esters must have a minimum viscosity of 2 $mm^2/s$ at 100° C.

It is also possible to use polyol esters (based for example on neopentyl glycol, pentaerythritol or trimethylolpropane with corresponding monocarboxylic acids) and oligomer or polymer esters, for example those based on dicarboxylic acid, a polyol and a monoalcohol.

It is also possible to use esters of aromatic di-, tri- and tetracarboxylic acids with long-chain aliphatic alcohols composed solely of carbon, hydrogen and oxygen, the total number of carbon atoms of the esters being 22 or more and the molecular weight being from 370 to 1500, preferably from 414 to 1200.

Suitable esters are in particular the adipates, phthalates, isophthalates, terephthalates and trimellitates of isooctanol, isononanol, isodecanol and isotridecanol and mixtures thereof.

Comparative tests for demonstrating the synergistic effect:

Accompanying Table 1 is a summary of the experimental results of systematic tests of detergents combined with various base oil systems. The test method used was the Opel Kadett test (CEC-F-02-T-79). The test fuel used was a premium-grade gasoline from a West German refinery of Research octane number 98 with a lead content of 0.15 g of Pb/1. (Under the standardized test conditions the buildup of deposit in the Opel Kadett test engine varies very strongly with the quality of the test gasoline used. The test gasoline chosen left a deposit of from 300 to 450 mg per intake valve.) The results in the table show that, if pure detergents are used, amounts of from 600 to 800 ppm were necessary in order to reduce the level of deposits to below 10 mg per valve. When the detergent level is 300–400 ppm the deposits are on average below 50 mg per valve, and if only 150 ppm of detergent are used the deposits are of the order of about 110–180 mg per valve.

If the motor fuel additive used in the Opel Kadett test comprised esters alone, without the presence of detergents, an ester level of 500–800 ppm still left deposits of the order of 110–200 mg per valve, and it is found that the effectiveness of the esters decreases considerably if the total number of carbon atoms is below $C_{36}$.

Similarly, the sole use of polyethers based on propylene oxide, butylene oxide or a propylene oxide/butylene oxide mixture in an amount of from 400 to 700 ppm merely reduced the deposits on the intake valves to about 80–220 mg per valve.

Owing to the contribution by the base oil to the total detergency performance, the concentration of detergent in the motor fuel additive can be significantly reduced. This is extremely desirable on account of the abovementioned side effects. We therefore carried out a number of investigations where known detergents were subjected to the Opel Kadett test either in combination with esters alone or with polyethers alone. In each of these series of experiments, the detergent level was 150 or 200 ppm. The ester level was from 150 to 300 ppm. Table 3 shows with reference to a $C_9/C_{10}$-oxo oil phthalate on the one hand and tridecyl trimellitate on the other that, compared with using detergents alone and esters alone, it is possible to obtain a marked reduction in the amount of deposit formed. If oxo oil phthalate is used, the deposit is on average from 73 to 104 mg per valve. If a triisotridecyltrimellitate is used, the average deposit is from 62 to 78 mg per valve.

The use of polyethers alone combined with known detergents shows that polyethers based on butoxylated aliphatic alcohols are more effective than polyethers based on the same starting alcohols but alkoxylated with a propylene oxide/butylene oxide mixture. In the former case, the average deposit left is 68–82 mg per valve, while in the latter case it is still 84–93 mg per valve even at a higher ether level. Alkylphenol-started polyethers based on butylene oxide are more effective if combined alone with known detergents than polyethers started from aliphatic alcohols. The former polyethers left an average deposit of 30–45 mg per valve.

According to the present invention, then, esters and polyethers are used mixed with known detergents. The test showed that the synergistic effect increases with increasing polyether molecular weight and led in all the cases studied to average residual deposits of less than 20 mg per valve. A particularly effective combination was found to be that of a base oil mixture based on a phthalic or trimellitic ester with a polyether based on butylene oxide if the detergent component is based on a polybutene product. If more polar detergents are used, polyethers based on butene oxide produce fewer benefits over the mixed oxide or pure propene oxide.

TABLE 1

Detergency performance of various detergents in an Opel Kadett engine (comparative tests)

| Serial No. | DETERGENT Type | Dose (ppm) | ESTER Type | Dose (ppm) | ETHER Type | Dose (ppm) | Valve deposits OPEL KADETT TEST (mg/valve) |
|---|---|---|---|---|---|---|---|
| 1 | Polyisobutylamine, MW ca. 1000 ca. $C_{72}H_{147}NH_2$ (A) | 150 | — | — | — | — | 114 |
| 2 | EDTA tridecyl diamide imide (B) | 150 | — | — | — | — | 178 |
| 3 | EDTA tridecyl tetramide (C) | 150 | — | — | — | — | 156 |
| 4 | Triisononanoamidodiethylene butoxylate (D) | 150 | — | — | — | — | 128 |
| 5 | A | 300 | — | — | — | — | 39 |
| 6 | B | 400 | — | — | — | — | 48 |
| 7 | C | 300 | — | — | — | — | 44 |
| 8 | D | 400 | — | — | — | — | 38 |
| 9 | A | 600 | — | — | — | — | <10 |
| 10 | B | 800 | — | — | — | — | <10 |
| 11 | C | 600 | — | — | — | — | <10 |
| 12 | D | 800 | — | — | — | — | <10 |

TABLE 2

Detergency performance of esters and polyethers on intake valves in an Opel Kadett engine (comparative test)

| Serial No. | ESTER Type | Dose (ppm) | ETHER Type | Dose (ppm) | Valve deposits OPEL KADETT TEST (mg/valve) |
|---|---|---|---|---|---|
| 13 | Tetraethylhexyl bicyclo[2.2.2]-octene-tetracarboxylate | 600 | | | 178 |
| 14 | $C_9$-$C_{10}$-oxo oil phthalate (F) | 600 | | | 172 |
| 15 | Triisotridecyl trimellitate (G) | 600 | | | 111 |
| 16 | Triisononyl trimellitate (H) | 600 | | | 118 |
| 17 | Diisotridecyl adipate (I) | 600 | | | 254 |
| 18 | | | Polyether of tridecanol reacted with 8 mol of 1-butene oxide (K) | 600 | 202 |
| 19 | | | Polyether of tridecanol reacted with a mixture of propylene oxide and 1-butene oxide (1:1) (L) | 600 | 242 |
| 20 | | | Polyether of isononyl-phenol reacted with 8 mol of 1-butene oxide (M) | 600 | 140 |

TABLE 3

Detergency performance of combinations of detergents and esters or polyethers on intake valves on an Opel Kadett engine (comparative test)

| Serial No. | DETERGENT Type | Dose (ppm) | ESTER Type | Dose (ppm) | ETHER Type | Dose (ppm) | Valve deposits OPEL KADETT TEST (mg/valve) |
|---|---|---|---|---|---|---|---|
| 21 | A | 200 | F | 400 | — | — | 73 |
| 22 | B | 200 | F | 400 | — | — | 96 |
| 23 | C | 200 | F | 400 | — | — | 104 |
| 24 | D | 200 | F | 400 | — | — | 82 |
| 25 | A | 200 | G | 400 | — | — | 62 |
| 26 | B | 200 | G | 400 | — | — | 74 |
| 27 | C | 200 | G | 400 | — | — | 72 |
| 28 | D | 200 | G | 400 | — | — | 78 |
| 29 | B | 200 | | | K | | 68 |
| 30 | B | 200 | | | K | | 76 |
| 31 | C | 200 | | | K | | 73 |
| 32 | D | 200 | | | K | | 82 |
| 33 | A* | 200 | | | L | | 88 |
| 34 | B | 200 | | | L | | 93 |
| 35 | C | 200 | | | L | | 84 |
| 36 | D | 200 | | | L | | 85 |
| 37 | A* | 200 | | | M | | 30 |
| 38 | B | 200 | | | M | | 42 |
| 39 | C | 200 | | | M | | 38 |
| 40 | D | 200 | | | M | | 45 |

*Polybuteneamine from polyisobutene (Mw 1000) by chlorination and reaction with diethylenetriamine

TABLE 4

Detergency of ester/polyether base oil mixtures according to the present invention on intake valves in Opel Kadett engine

| Serial No. | DETERGENT Type | Dose (ppm) | ESTER Type | Dose (ppm) | ETHER Type | Dose (ppm) | Valve deposits OPEL KADETT TEST (mg/valve) |
|---|---|---|---|---|---|---|---|
| 41 | A | 200 | F | 200 | K | 200 | 18 |
| 42 | A | 200 | G | 300 | K | 100 | <5 |
| 43 | A | 200 | I | 100 | K | 300 | <10 |
| 44 | A | 200 | G | 300 | L | 100 | <10 |
| 45 | A | 200 | F | 300 | K | 100 | <10 |
| 46 | B | 200 | H | 200 | K | 200 | <10 |
| 47 | B | 200 | G | 300 | K | 100 | <10 |
| 48 | D | 200 | G | 200 | L | 200 | <10 |
| 49 | D | 200 | F | 200 | L | 200 | 17 |
| 50 | A | 100 | G | 300 | K | 100 | <5 |
| | B | 100 | | | | | |
| 51 | A | 100 | H | 300 | L | 100 | <5 |
| | D | 100 | | | | | |

The novel motor fuel based on a detergent dose of only 100–200 ppm combined with a polyether/ester base oil mixture made it possible to solve the undesirable phenomenon of valve stick in a highly satisfactory manner.

To test the antivalve stick effect, a Volkswagen Transporter with a 1.9 l (44 kW) flat engine (water-cooled) is subjected to a road test. The road test is carried out under the following conditions:

10 km at a speed of 50 km/h
10 minutes at rest
10 km at a speed of 60 km/h
10 minutes at rest The cycle is repeated until about 130 km have been covered in a day. After the vehicle has been left to stand overnight (at from +5° C. to −5° C.), the intake valve stems are assessed visually with the aid of a motorscope. The exhaust manifold is then removed and a compression diagram is prepared. After the engine has been reassembled, trial starts are carried out. The starting characteristics and the running of the engine immediately on starting are described.

Table 5 below shows the results from the above-described Volkswagen valve stick test. The advantages of using the ester/polyether base oil mixture according to the present invention are obvious.

As mentioned, there is a buildup of sparingly volatile, or involatile, additive components in the oil sump of an engine between oil changes. The partially burnt hydrocarbons and nitrogen oxides (NOX) which circulate through the oil sump as blow-by gases give rise to chemical reactions at the high oil sump temperatures of from 120° to 150° C. Olefin-containing gasoline components and high-boiling aromatic gasoline fractions, but also the lubricant oil additives present in the oil sump, are subjected to nitration and increasingly thereafter to polymerizations and resinifications, which finally prove too much for the dispersants present in the engine oil. The consequences are gumming, precipitates and sludge. Polyisobutylamines are neutral as regards sludge formation in engine oil. In some cases, when the polyisobutene radical is linked to a dispersing polyamine group, such polyisobuteneamines in fact even improve the sludge characteristics of engine oils. Detergents of another chemical structure, in particular those having amide or imide groups, can only be considered neutral with respect to sludge formation in engine oil if used in an appropriately small amount.

TABLE 5

Valve stick test in 1.9 l VW Transporter (44 kW) with water-cooled flat engine

| Serial No. | Additive Type | Additive Dose (ppm) | Test temperature (°C.) | Deposits on valve stems (1) | Compression loss yes/no | Compression loss in cylinder | Start characteristics (2) | Engine run after start (3) | Remarks |
|---|---|---|---|---|---|---|---|---|---|
| 9 | A | 600 | −1 | ++ | yes | 4 | (b) | •• | Comparative |
| 52 | A* | 600 | −3 | +++ | yes | 1-4 | (c) | — | tests |
| 6 | B | 400 | −5 | ++ | yes | 1 | (c) | — | |
| 10 | B | 800 | −3 | +++ | yes | 1-4 | (c) | — | |
| 53 | A** | 400 | −3 | +++ | yes | 1-4 | (c) | — | |
| 43 | A,I,K | 200/100/500 | −5 | − | no | — | (a) | • | Tests |
| 45 | A,F,K | 200/400/200 | −2 | + | no | — | (b) | • | according |
| 48 | D,G,L | 200/400/200 | −6 | − | no | — | (a) | • | to |
| 50 | A,B,G,K | 200/100/400/100 | −3 | − | no | — | (a) | • | the |
| 51 | A,D,H,L | 150/100/400/150 | −1 | − | no | — | (a) | • | invention |

*cf. footnote Table 3
**Polybutaneamine of average molecular weight 1250
(1) Assessment:
+++ strong
++ medium
+ low
− none
(2) Assessment:
(a) engine starts immediately within 4 seconds
(b) engine starts after 5-10 seconds
(c) engine does not start
(3) Assessment:
• engine runs smoothly without problems
•• engine runs jerkily/splutters

We claim:

1. A motor fuel containing an amino or amido containing detergent and, as a fuel-detergent-enhancing additive in the form of a base oil, 50 to 5000 ppm of a mixture of:

(a) a polyether obtained by the reaction of (1) one mole of a starter selected from the group consisting of aliphatic and aromatic mono-, di- or poly- alcohols, amines, amides and alkylphenols and (2) at least about 8 moles of propylene oxide or butylene oxide and having a total molecular weight of not less than 500, and (b) an ester of a carboxylic acid selected from the group consisting of adipic, phthalic, isophthalic, terephthalic and trimellitic acid and a long-chain alkanol or polyol, the ester having a minimum viscosity of 2 $mm^2/s$ at 100° C. and a molecular weight from 370 to 1500 and wherein the weight ratio of (a) to (b) is from 20:80 to 80:20.

2. A motor fuel as defined in claim 1, wherein an amount of from 8 to 30 moles of propylene oxide or butylene oxide (2) is reacted with one mole of starter (1).

3. A motor fuel as defined in claim 1, wherein the weight ratio of polyether:ester is from 5:95 to 95:5.

* * * * *

UNITED STATES PATENT AND TRADEMARK OFFICE

CERTIFICATE OF CORRECTION

PATENT NO. : 5,004,478

DATED : Apr. 2, 1991

INVENTOR(S) : Hans-Henning VOGEL et al.

It is certified that error appears in the above-identified patent and that said Letters Patent is hereby corrected as shown below:

Claim 1, Col. 10, Line 7

That part reading "20:80 to 80:20" should read --5:95 to 95:5--

Claim 3, Col. 10, Line 13

That part reading "5:95 to 95:5" should read --20:80 to 80:20--

Signed and Sealed this

Eighth Day of December, 1992

*Attest:*

*Attesting Officer*

DOUGLAS B. COMER

*Acting Commissioner of Patents and Trademarks*